US011812865B2

(12) United States Patent
Costaglia

(10) Patent No.: US 11,812,865 B2
(45) Date of Patent: Nov. 14, 2023

(54) CONTROL MECHANISM FOR A CHAIR

(71) Applicant: L&P PROPERTY MANAGEMENT COMPANY, South Gate, CA (US)

(72) Inventor: Massimo Costaglia, Santa Giustina in Colle (IT)

(73) Assignee: L&P Property Management Company, South Gate, CA (US)

( * ) Notice: Subject to any disclaimer, the term of this patent is extended or adjusted under 35 U.S.C. 154(b) by 25 days.

(21) Appl. No.: 17/432,173

(22) PCT Filed: Feb. 13, 2020

(86) PCT No.: PCT/EP2020/053766

§ 371 (c)(1),
(2) Date: Aug. 19, 2021

(87) PCT Pub. No.: WO2020/173715

PCT Pub. Date: Sep. 3, 2020

(65) Prior Publication Data

US 2022/0183468 A1 Jun. 16, 2022

(30) Foreign Application Priority Data

Feb. 27, 2019 (EP) ..... 19159655

(51) Int. Cl.
*A47C 3/18* (2006.01)

(52) U.S. Cl.
CPC ..... *A47C 3/18* (2013.01)

(58) Field of Classification Search
CPC ..... A47C 3/18
See application file for complete search history.

(56) References Cited

U.S. PATENT DOCUMENTS 4,441,220 A * 4/1984 Peterson ..... A47C 3/18 5/607
6,688,689 B1 * 2/2004 Thorn ..... A47C 7/14 297/313

(Continued)

FOREIGN PATENT DOCUMENTS

DE 202009011789 U1 12/2009

OTHER PUBLICATIONS

International Search Report an Written Opinion dated Feb. 27, 2020 in Application No. PCT/EP2020/053766, 12 pages.

*Primary Examiner* — Philip F Gabler
(74) *Attorney, Agent, or Firm* — SHOOK HARDY & BACON L.L.P.

(57) ABSTRACT

A control mechanism for a chair comprises a baseplate configured to be coupled to a chair base assembly, a support plate configured to be coupled to a chair seat, and an elastic element arranged between the base plate and the support plate. The elastic element enables the support plate to be tilted with respect to the base plate around a first tilt axis and a second tilt axis different from the first tilt axis. The control mechanism further comprises a control handle configured to be actuated in an actuating direction, and at least one stop element. Each stop element is arranged between the base plate and the support plate and configured to limit a minimum distance between the base plate and the support plate at the position of the corresponding stop element. A stop element adjust mechanism is coupled to the control handle and configured to adjust the minimum distance of each stop element in response to actuating the control handle in the actuating direction.

14 Claims, 9 Drawing Sheets

(56) References Cited

U.S. PATENT DOCUMENTS

| | | | | |
|---|---|---|---|---|
| 7,686,396 | B2 * | 3/2010 | Schaaf | A47C 3/0255<br>297/313 |
| 7,922,247 | B2 * | 4/2011 | Dickie | A47C 7/14<br>297/264.1 |
| 9,192,236 | B2 * | 11/2015 | Weiss | A47C 3/18 |
| 9,289,067 | B2 * | 3/2016 | Meyer | A47C 7/14 |
| 9,661,929 | B1 * | 5/2017 | Koh | A47C 7/445 |
| 10,213,024 | B2 * | 2/2019 | Reinhard | A47C 9/02 |
| 10,433,644 | B2 * | 10/2019 | Kamiya | A47C 3/18 |
| 2011/0278418 | A1 * | 11/2011 | Kuo | A47C 3/18<br>248/425 |
| 2012/0306249 | A1 * | 12/2012 | Jung | A47C 3/026<br>297/313 |

* cited by examiner

CONTROL MECHANISM FOR A CHAIR

CROSS-REFERENCE TO RELATED APPLICATIONS

This application claims priority under 35 U.S.C. § 365 to PCT/EP2020/053766, filed on Feb. 13, 2020, entitled "Control Mechanism for a Chair," and European Patent Application No. EP19159655.0, filed Feb. 27, 2019, entitled "Control Mechanism for a Chair," the entirety of the aforementioned applications are incorporated by reference herein.

FIELD OF THE INVENTION

The present invention relates to a control mechanism for a chair. In particular, the present invention relates to a control mechanism for a chair which enables a chair seat to be tilted in various directions. The present invention relates furthermore to a chair comprising the control mechanism.

BACKGROUND OF THE INVENTION

Chairs, for example office-type chairs, may include mechanisms for adjusting a seating position, for example a height adjustment of the chair seat, and an adjustment of an inclination of the chair seat and a chair back. These chair adjustments allow the user to change the sitting position in the chair as desired, such that fatigue may be minimized during long sitting periods.

Fatigue may also be reduced, when the chair seat is freely tiltable in any direction or in some directions. Such a tilting is also called 3D wobbling. A tiltable chair seat may be tilted upon displacement of the center of gravity of the user sitting on the chair, and the tiltable chair seat may be urged back automatically to its initial non-tilted position by an elastic element, for example springs. However, it may be wanted that the chair seat is not tiltable always, but has a fixed position upon request such that the tilt functionality is adjustable by the user. Further, as a general requirement, easy to use chair adjustments may be desirable, for example a low number of control handles may be wanted.

BRIEF SUMMARY OF THE INVENTION

There is a need in the art for a control mechanism for a chair which addresses some of the above needs. In particular, there is a need in the art for a control mechanism for a chair which is a simple and reliable construction and which provides easy adaption to different seating position requirements.

According to the present invention, this object is achieved by a control mechanism for a chair as defined in the independent claim. The dependent claims define embodiments of the invention According to an embodiment, a control mechanism for a chair is provided. The control mechanism comprises a base plate, which is configured to be coupled to a chair base assembly, and a support plate, which is configured to be coupled to a chair seat. The control mechanism comprises furthermore an elastic element which is arranged between the base plate and the support plate. The elastic element enables the support plate to be tilted with respect to the base plate around a first tilt axis and a second tilt axis. The second tilt axis is different from the first tilt axis. The elastic element may be made of a rubber material or injected thermoplastic. In other words, the elastic element enables the support plate to be tilted with respect to the base plate such that a chair seat coupled to the support plate may be inclined in any direction. For example, when inclining the chair seat coupled to the support plate, the elastic element may be compressed in an area where the chair seat is moved in a downward direction. The control mechanism further comprises a control handle configured to be actuated in an actuating direction. Furthermore, the control mechanism comprises at least one stop element. Each stop element of the at least one stop element is arranged between the base plate and the support plate and configured to limit a minimum distance between the base plate and the support plate at the position of the corresponding stop element. A stop element adjust mechanism of the control mechanism is coupled to the control handle and configured to adjust the minimum distance of each stop element of the at least one stop element in response to actuating the control handle in the actuating direction. In other words, at least one stop element, preferably a plurality of stop elements, is provided. Each stop element is adjustable under control of the stop element adjust mechanism and the control handle. Adjusting a stop element causes that the stop element limits the minimum distance between the base plate and the support plate at the position of the stop element. For example, the base plate and the support plate may be coupled to each other such that the distance between a center of the base plate and a center of the support plate is limited. For example, the support plate is coupled to the base plate via a retaining bolt at the centers thereof. Now, the support plate may be inclined with respect to the base plate by a user sitting on the chair seat. This results in a reduced distance between the support plate and the base plate at a particular position. The stop element may be arranged at this particular position and may limit the minimum distance at the particular position such that the amount the support plate may be inclined with respect to the base plate may be enlarged or reduced depending on the stop element. Thus, an inclination of the support plate with respect to the base plate may be enabled or disabled in certain directions. By using a plurality of stop elements which may be individually controlled to adjust the minimum distance between the base plate and the support plate at the position of the corresponding stop element, inclination of the support plate with respect to the base plate may be enabled or disabled for particular directions, or may be enabled in all directions, or may be disabled in all directions. However, the elastic element will force back the support plate to the starting position. A user sitting on the chair can thus adjust the chair seat such that it is fixed in the starting position, elastically tiltable in only one direction or a restricted area of directions, or elastically tiltable in any direction such that a three-dimensional movement of the chair seat is enabled. When the chair seat is elastically tiltable in one or more directions, an active sitting on the chair seat may be promoted as the user may have to balance when sitting on the chair. This may cause the movement of the pelvis area and may contribute to strengthen the back muscles at the same time. Further fatigue may be reduced.

According to an embodiment, each stop element of the at least one stop element extends from the base plate towards the support plate and is configured to be separately displaceable between a retracted position and an extended position. In the extended position, the stop element is located further towards the support plate than in the retracted position. Displacing the stop element may be performed by a stop element adjust mechanism. For example, in the extended position, the stop element may be moved by the stop element adjust mechanism to such an extent in the direction of the support plate that it abuts against the support plate thus inhibiting that the support plate can be moved closer to the base plate at the position of the corresponding stop element. Thus, the minimum distance between the support plate and the base plate is limited by the stop element at the position of the stop element. This may reduce the ability of the support plate to be inclined or tilted in the direction at the corresponding stop element. With a plurality of stop elements arranged at different locations, the tilting of the support plate in certain directions may be enabled, disabled, or restricted.

A number of stop elements in the extended position may depend on an extent the control handle is actuated in the actuating direction. Thus, by actuating the control handle in the actuating direction the number of stop elements in the extended position may be increased, which reduces the directions in which the support plate may be tilted.

According to a further embodiment, the control mechanism may comprise four stop elements. The control handle is configured to be actuated in the actuating direction in a first handle position, a second handle position and a third handle position. In the first handle position, all four stop elements are in the retracted position. In the second handle position, to stop elements are in the retracted position and the other two stop elements are in the extended position. In the third handle position, all four stop elements are in the extended position. For example, with respect to a center of the chair seat, one stop element may be arranged in the front area of the chair seat, one stop element may be arranged in the rear area of the chair seat, one stop element may be arranged in the left area of the chair seat, and one stop element may be arranged in the right area of the chair seat. In the first handle position, when all stop elements are in the retracted position, the chair seat may be tiltable in any direction. In the second handle position, when for example the stop elements in the left area and the right area are in the extended position and the stop elements in the front area and the rear area are in the retracted position, the chair seat may be tiltable in the front/rear direction only, and may not be tilted in the left/right direction anymore. In the third handle position, when all four stop elements are in the extended position, the chair seat may not be tiltable in any direction.

In another embodiment, the stop element adjust mechanism comprises a rotatable angular plate. The rotatable annular plate may be arranged such that a center of the angular plate is essentially aligned to a pole or gas cylinder of the chair base assembly and may be rotatable around this center. At least one wedge element extends from the annular plate. In particular, for each stop element a corresponding wedge element may be provided at the angular plate. Each wedge element is assigned to a corresponding stop element. The minimum distance limited by each stop element is adjusted by the assigned wedge element upon rotating the annular plate. For example, the stop element may be arranged with an upper end facing the support plate and the lower end facing the angular plate. When the annular plate is rotated, for example driven by a movement of the control handle, the wedge element moves relative to the assigned stop element. Each wedge element may provide a ramp surface on which a lower end of the assigned stop element is sliding such that the movement of the wedge element in one direction may urge the assigned stop element in the extended position, and a movement of the wedge element in the opposite direction may release the assigned stop element in the retracted position. As the stop element adjust mechanism comprises a corresponding wedge element for each stop element, with a single control handle the above described states of tilt possibilities may be configured.

The plurality of stop elements, for example the above described four stop elements, may be arranged equidistant along the annular plate.

The elastic element may comprise for example an elastic ring. The elastic ring may be arranged such that a center of the elastic ring is essentially aligned to a longitudinal axis of the pole or gas cylinder of the chair base assembly, and may essentially be aligned to a center of the rotatable annular plate.

A first face of the elastic ring may be molded to the base plate and a second face of the elastic ring opposing the first face may be molded to the support plate. By molding the elastic ring to the base plate and the support plate, a rotation of the support plate with respect to the base plate may be prohibited and at the same time a fixed but tiltable arrangement of the base plate with respect to the support plate may be achieved.

Additionally or as an alternative, a coupling element providing a pivotable coupling of the base plate and the support plate may be provided. The coupling element may be arranged in a central position of the elastic ring. The coupling element may inhibit rotation of the support plate with respect to the base plate around the central position. Furthermore, the coupling element may limit the maximum distance between the support plate and the base plate at the coupling position, for example at the centers of the support plate and the base plate. Thus, a fixed but tiltable arrangement of the base plate with respect to the support plate may be achieved.

A vertical direction may be defined with respect to a chair standing on a ground, i.e. the vertical direction extends from the ground in an upright direction. When the chair is standing on the ground, the vertical direction is defined by a direction in which the chair base assembly, the base plate, the support plate and the chair seat are subsequently arranged. The first tilt axis may extend essentially perpendicular to the vertical direction, and the second tilt axis may extend essentially perpendicular to the vertical direction and the first tilt axis. The chair base assembly may enable a rotation of the base plate around the vertical direction. Thus, the chair seat may be rotatable/tiltable in all three spatial dimensions, i.e. rotatable around the vertical direction and tiltable around the first and second tilt axes.

The control mechanism may furthermore comprise an anti-rotation element arranged between the base plate and the support plate. The anti-rotation element is configured to prohibit a rotation of the support plate with respect to the base plate around the vertical direction. By prohibiting a rotation of the support plate with respect to the base plate, a fixed orientation of the base plate including the control handle with respect to the chair seat may be achieved such that the control handle and its handle positions may be well defined with respect to the user sitting on the chair seat.

According to a further embodiment, the control handle has a longitudinal shape. A proximal end of the control handle is coupled to the base plate and the control handle extends from the base plate. The control mechanism is configured such that actuating the control handle in the actuating direction comprises moving a distal end of the control handle in the circumferential direction around the vertical direction. Thus, moving the distal end of the control handle in the circumferential direction may be easily translated in a rotational movement of the rotatable annular plate, i.e. the stop element adjust mechanism, which drives the stop elements.

In a further embodiment, the chair base assembly comprises a height control mechanism configured to enable the chair seat of the chair to be displaced in the vertical direction. The control handle is configured to be activated in a further actuating direction. Actuating the control handle in the further actuating direction effects actuating the height control mechanism. Actuating the control handle in the further actuating direction comprises moving the distal end of the control handle in the vertical direction. For example, the height control mechanism may comprise a gas cylinder mechanism or other lifting mechanism supported by the chair base assembly. For raising or lowering the chair seat, the control handle may be moved upwards or downwards in the vertical direction, whereas configuring the released tilt directions of the chair seat is accomplished by moving the control handle in the horizontal circumferential direction. Thus, with a single control handle full adaption of the chair seat configuration may be achieved.

The control mechanism may furthermore comprises an annular cover element attached to the circumferential edge of the support plate. The annular cover element further extends to the circumferential edge of the base plate. The annular cover element may therefore cover in particular the stop elements, the elastic element and the stop element adjust mechanism for aesthetic reasons. Furthermore, the cover element may prohibit that the users finger may be placed between the base plate and the support plate, thus permitting that the finger may be clamped or pinched between the base plate and the support plate when tilting the support plate with respect to the base plate.

The control mechanism may comprise furthermore an indexing mechanism. The indexing mechanism may comprise an elastic index element and three index detents provided at the stop element adjustment mechanism such that the elastic index element engages with a first index detent of the three index detents in the first handle position, engages with a second index detent of the three index detents in the second handle position, and engages with a third index detent of the three index detents in the third handle position. Thus, the control handle may be reliably moved and held in the first, second and third handle positions.

According to another embodiment, a chair is provided. The chair comprises a chair base assembly, a chair seat and a control mechanism. The control mechanism comprises a base plate, which is coupled to the chair base assembly, and a support plate, which is coupled to the chair seat. The control mechanism comprises furthermore an elastic element which is arranged between the base plate and the support plate. The elastic element enables the support plate to be tilted with respect to the base plate around a first tilt axis and a second tilt axis, which is different from the first tilt axis. The control mechanism comprises further a control handle configured to be actuated in an actuating direction. Furthermore, the control mechanism comprises at least one stop element. Each stop element of the at least one stop element is arranged between the base plate and the support plate and configured to limit a minimum distance between the base plate and the support plate at the position of the corresponding stop element. A stop element adjust mechanism of the control mechanism is coupled to the control handle and configured to adjust the minimum distance of each stop element of the at least one stop element in response to actuating the control handle in the actuating direction. Adjusting a stop element causes that the stop element limits the minimum distance between the base plate and the support plate at the position of the stop element. Thus, an inclination of the support plate with respect to the base plate may be enabled, disabled or restricted in certain directions. A user sitting on the chair can adjust the chair seat such that it is fixed in the starting position, elastically tiltable in only one direction or a reduced area of directions, or elastically tiltable in any direction such that a three-dimensional movement of the chair seat is enabled. When the chair seat is elastically tiltable in one or more directions, an active sitting on the chair seat may be promoted as the user may have to balance when sitting on the chair.

The control mechanism may be the control mechanism of any aspects or embodiments of the invention.

The control mechanism and the chair according to embodiments may be utilized for various applications, for example, the control mechanism may be utilized in an office chair.

BRIEF DESCRIPTION OF THE DRAWINGS

Embodiments of the invention will be described with reference to the accompanying drawings.

DETAILED DESCRIPTION OF EMBODIMENTS

Exemplary embodiments of the invention will be described with reference to the drawings. While some embodiments will be described in the context of specific fields of application, such as in the context of an office type chair, the embodiments are not limited to this field of application. The features of the various embodiments may be combined with each other unless specifically noted otherwise. Same reference signs in the various drawings refer to similar or identical components.

Figure 1:
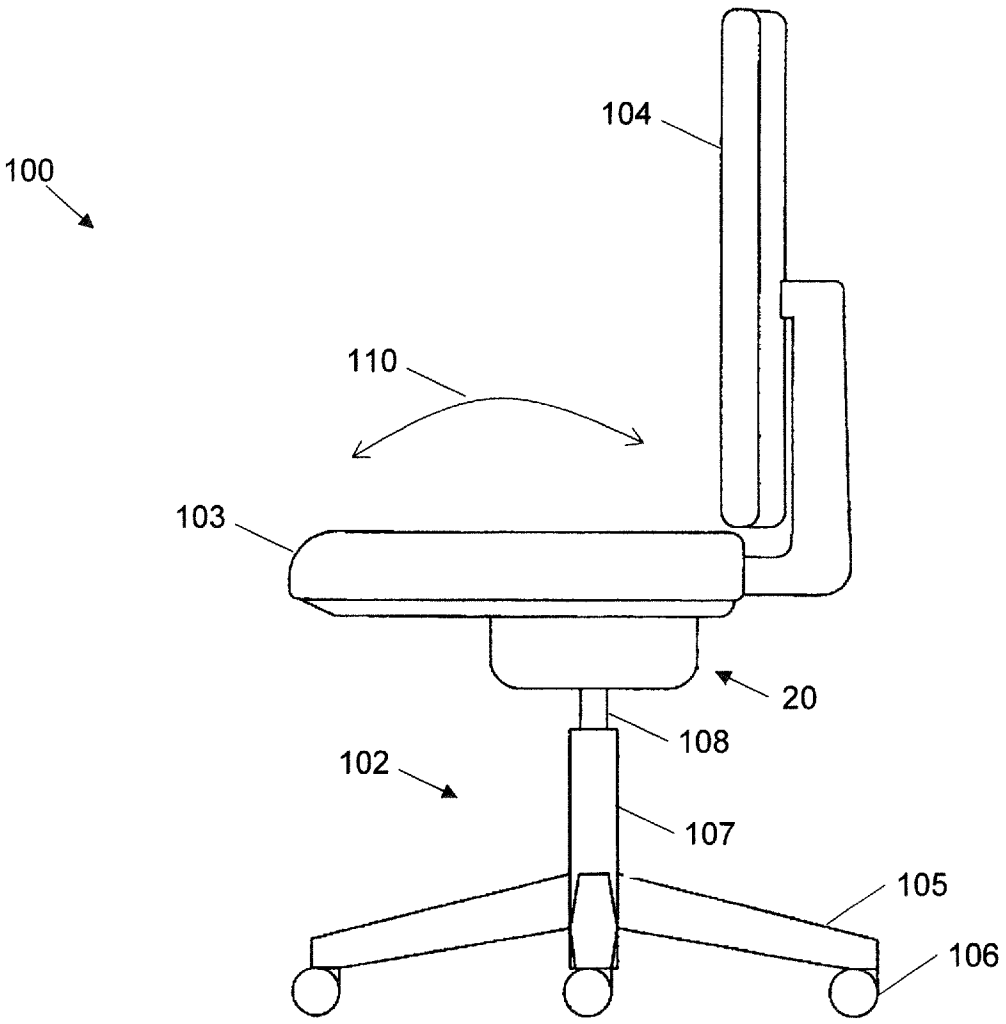
FIG. 1 is a schematic view of a chair having a control mechanism according to an embodiment.

FIG. 1 shows schematically a chair 100, for example an office chair, which includes the control mechanism 20. The chair 100 has a chair base assembly 102 and a superstructure. The superstructure includes a chair seat 103, a chair back 104 and components to interconnect the seat 103 with the chair back 104. The base assembly 102 includes a pedestal column 107, a number of support legs 105 extending radially from the column 107 and a corresponding number of casters 106 supported on the outer ends of the support legs 105. A gas cylinder 108 or another lifting mechanism may be supported by the column 107 to enable the height of the seat 103, and thus of the chair superstructure, to be adjusted by a user.

It is to be understood that the terms "forward", "rearward" and "lateral", as used herein, each have a particular meaning that is defined in relation to a flat support surface beneath the chair 100 (for example parallel to a floor on which the casters 106 rest) and in relation to an occupant of the chair. The flat support surface defines a horizontal plane. The vertical direction is defined perpendicular to the horizontal plane. For example, the term "forward" refers to a direction moving away from the back 104 and in front of a chair occupant along an axis which extends parallel to such a flat support surface, while the term "rearward" refers to a direction opposite to the forward direction. The term "lateral" refers to a generally horizontal direction perpendicular to both the forward and rearward direction and extending parallel to the aforementioned flat support surface. The attachment between a base plate of the control mechanism 20 and the chair base assembly 102 also defines which plane of the control mechanism 20 will be oriented horizontally in the installed state of the control mechanism 20. As will be described in more detail in the following, the control mechanism 20 enables the seat 103 to be tilted in the forward/rearward direction as indicated by arrow 110 in FIG. 1, and additionally the control mechanism 20 enables the seat 103 to be tilted in the lateral direction, i.e. to the left and to the right. The control mechanism 20 may enable the chair seat 103 to be tilted simultaneously in the forward/rearward direction and the lateral direction. Furthermore, the column 107 in combination with the gas cylinder 108 may enable the seat 103 to be rotated around an axis in the vertical direction. Thus, a three-dimensional movement of the chair seat 103 may be enabled. Furthermore, the control mechanism 20 may be adjusted upon actuation of a control handle of the control mechanism 20 by the user to restrict the tilt capabilities of the seat 103 in the forward/rearward direction and left/right direction.

Figure 2:
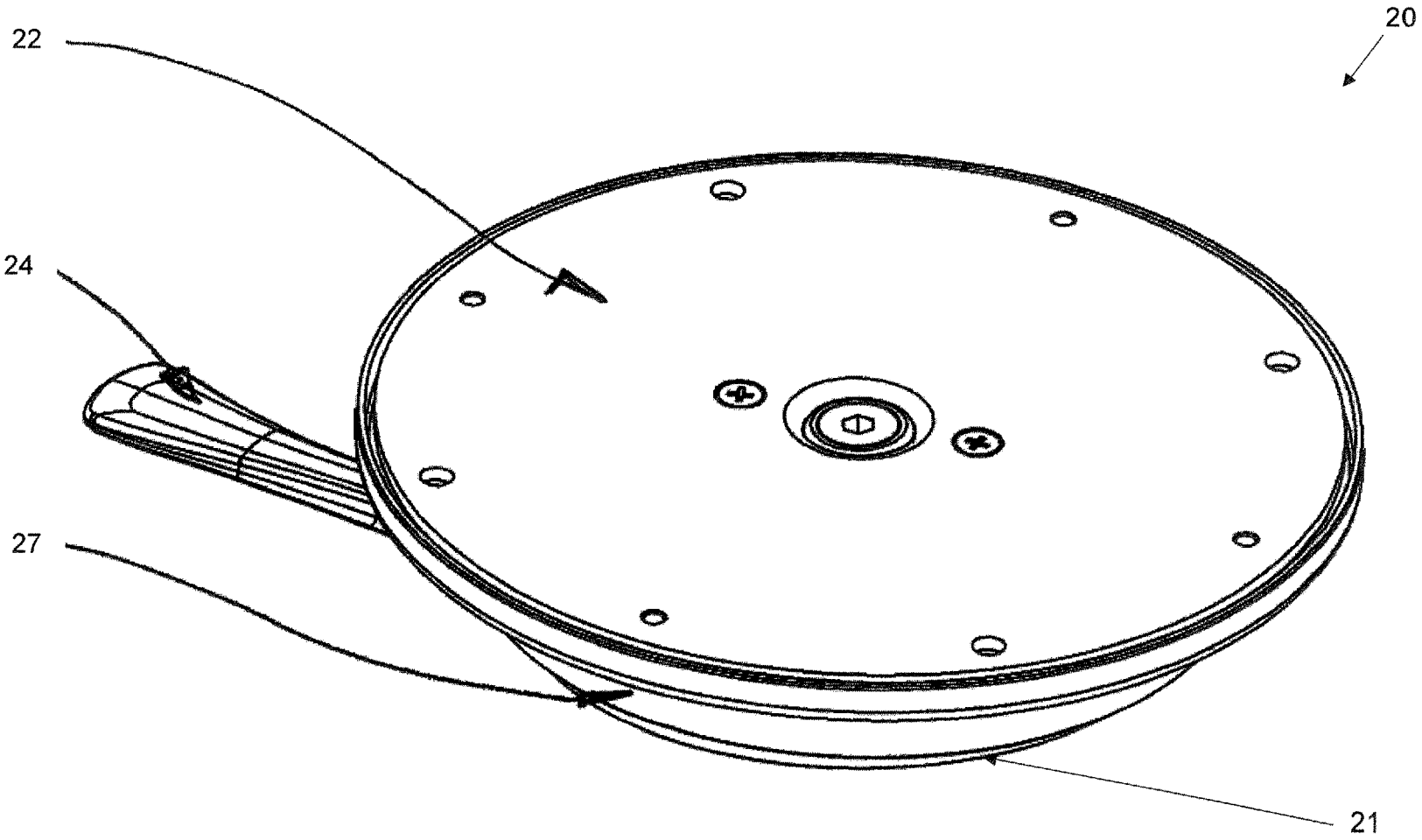
FIG. 2 is a schematic perspective view of a control mechanism according to an embodiment.

FIG. 2 shows a perspective view of the control mechanism 20. The control mechanism 20 comprises a support plate 22, which may be coupled to the chair seat 103. For coupling the support plate 22 to the chair seat 103, a plurality of holes may be provided and the chair seat 103 may be mounted to the support plate 22 using corresponding bolts. For example, the support plate 22 may be made of steel, aluminum or plastics. The control mechanism 20 comprises furthermore a base plate 21, which may be coupled to the chair base assembly 102. The base plate 21 may be made of steel, aluminum or plastics. A cover 27 may be mounted at the support plate 22. The cover 27 may have the annular shape and may extend from the support plate 22 to the base plate 21 thus covering components arranged between the base plate 21 and the support plate 22. Furthermore, the cover 27 may prevent that fingers of a user get in the space between the support plate 22 and the base plate 21 and get pinched or may otherwise interfere with components arranged between the support plate 22 and the base plates 21. Furthermore, the control mechanism 20 comprises a control handle 24 which is extending radially from the center of the control mechanism 20.

Figure 3:
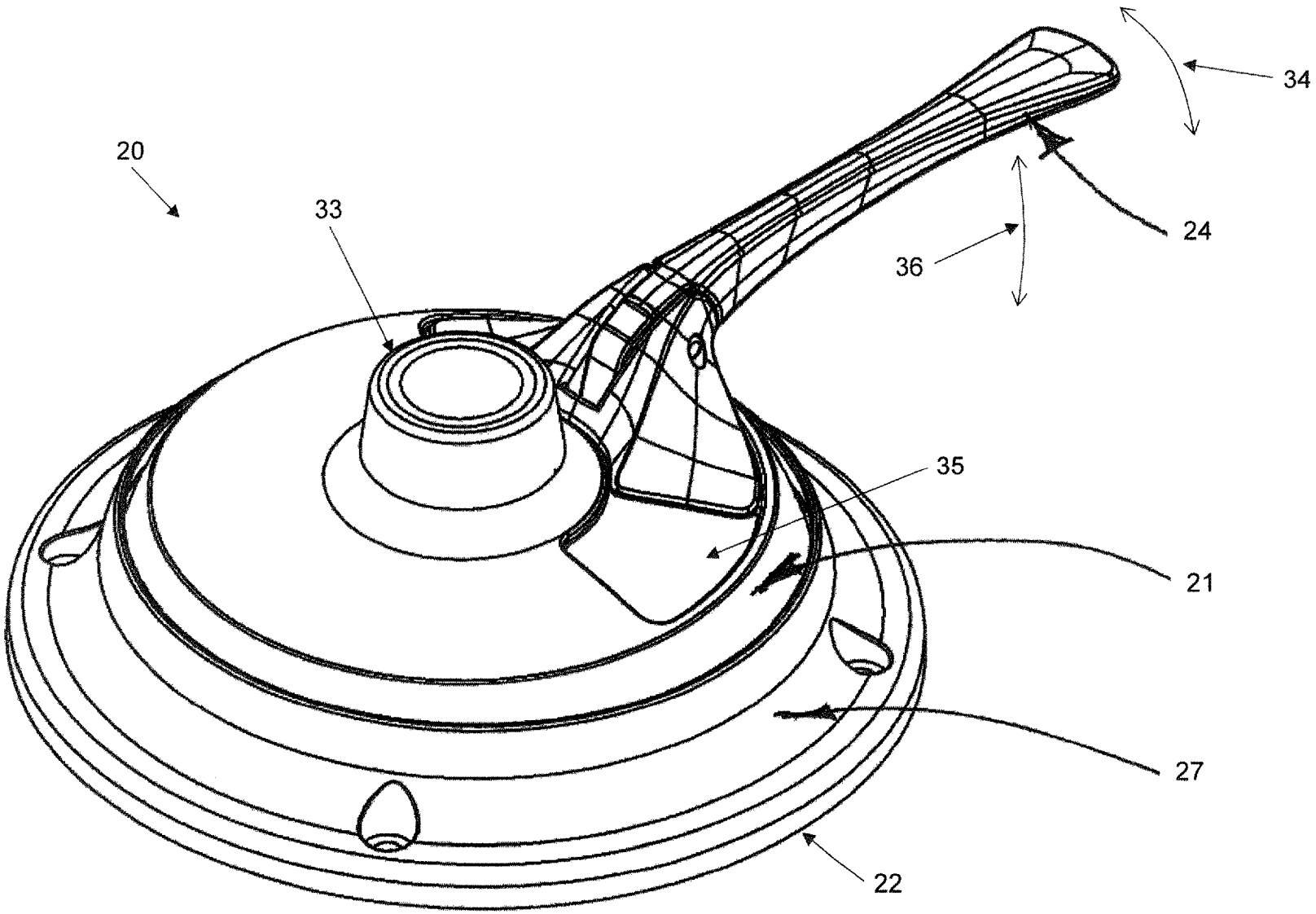
FIG. 3 is another schematic perspective view of the control mechanism of FIG. 2.

FIG. 3 shows a further perspective view of the control mechanism 20, viewed from a bottom side of the control mechanism 20. As can be seen, the cover 27 completely covers the space between the base plate 21 and the support plate 22. The base plate 21 comprises a connection part 33 for coupling the base plate 21 to the chair base assembly 102, for example to the gas cylinder 108. As will be described in more detail in the following, the control handle 24 is movable in two directions. First, the distal end of the control handle 24 may be moved in the vertical direction as indicated by arrow 36. When moving the control handle 24 for example in the upward direction, the gas cylinder 108 may be activated such that the height of the chair seat 103 may be adjusted. Second, the control handle 24 may be moved such that the distal and of the control handle is moving along a horizontal circular path as indicated by arrow 34. A cutout 35 in the base plate 21 limits the circular path along which the control handle 24 may be moved. Upon moving of the control handle 24 along the horizontal circular path, an elastic tilting of the chair seat, a so-called wobbling, may be enabled and disabled as will be explained below in more detail.

Figure 4:
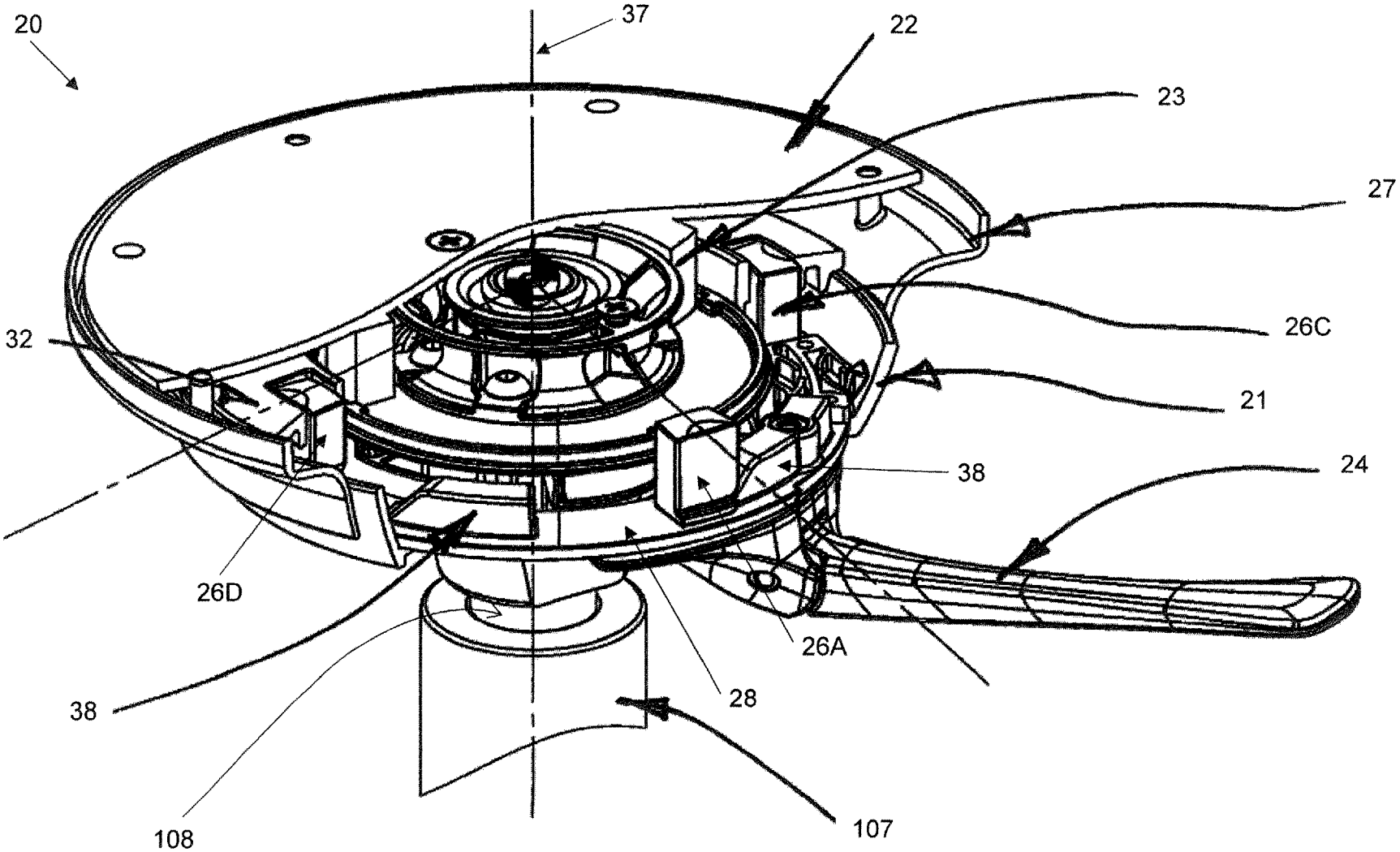
FIG. 4 is a schematic partial perspective view of the control mechanism of FIG. 2.

FIG. 4 shows schematically a partially cutaway perspective view of the control mechanism 20. The connection port 33 of the base plate 31 is coupled to the gas cylinder 108 provided in the column 107. At the base plate 21, a stop element adjust mechanism 28 is arranged. The stop element adjust mechanism 28 has an annular form. The stop element adjustment mechanism 28 may be rotatable around a vertical central axis 37. The stop element adjustment mechanism 28 is coupled to the control handle 24 through the cutout 35 such that the stop element adjustment mechanism 28 may be rotated under control of the control handle 24. The stop element adjustment mechanism 28 is provided with four wedge elements 38 (only two wedge elements are visible in FIG. 4), each providing a ramping section and a plateau. A corresponding stop element 26A-26D is assigned to each wedge element 38 (only stop elements 26A, 26C and 26D are visible in FIG. 4, stop element 26B is arrange at a diametrically opposite to stop element 26A). The stop elements 26A-26D do not rotate together with the stop element adjustment mechanism 28 such that, upon rotation of the stop element adjustment mechanism 28, the wedge element 38 moves relative to the assigned stop element 26A-26D. When the stop element adjustment mechanism 28 is rotated in the clockwise direction, the stop element 26A-26D comes in contact with the ramping section of the assigned wedge element 38 and the stop element 26A-26D moves upwards in the vertical direction until it reaches the plateau of the wedge element 38. The stop elements 26A-26D are guided in corresponding guides provided in a conical limiter element 32, which is fixed at the base plate 21. Thus, depending on the position of the wedge element 38, the assigned stop element 26A-26D may be either be in an extended position, in which it protrudes upwards from the conical limiter element 32, or may be in a retracted position, in which it does not protrude from the conical limiter element 32.

An elastic element 23 is arranged between the base plate 21 and the support plate 22. The elastic element 23 enables the support plate 22 to be tilted with respect to the base plate 21 by elastic compression of the elastic element 23. The elastic element 23 may have an annular shape and may be arranged concentrically to the central axis 37. For example, the elastic element 23 may be made of rubber material or injected thermoplastic. As long as the stop elements 26A-26D are not protruding from the conical limiter element 32, the support plate 22 may be tilted around any horizontal axis until it abuts against the conical limiter element 32. However, when one or more of the stop elements 26A-26D are in the extended position and thus protruding from the conical limiter element 32 in the direction of the support plate 22, tilting of the support plate may be restricted. In other words, a stop element 26A-26D limits the minimum distance between the support plate 22 and the base plate 21 when tilting the support plate 22 in a vertical downwards direction at the location of the corresponding stop element 26A-26D.

The four stop elements 26A-26D may be arranged equidistant along the ring shaped form of the conical limiter element 32, for example a first stop element 26C may be arranged at the forward side of the chair seat, a second stop element 26D may be arranged at the rearward side of the chair seat, the third stop element 26B may be arranged at the left side of the chair seat, and a fourth stop element 26A may be arranged at the right side of the chair seat (as seen by a user chair 100). For example, when the third element 26B and fourth stop element 26A are in their extended positions, whereas the first stop element 26C and second stop element 26D are in their retracted positions, the support plate 22 may only be tilted in the forwarded and rearward direction, but not in the lateral direction anymore. In case all for stop elements 26A-26D are in their extended positions, the support plate 22 may not be tiltable anymore in any direction.

The cover 27 is mounted at the support plate 22 and extends to the base plate 21 such that it at least partially overlaps an edge of the base plate 21. However, the cover 27 may not be fixed to the base plate 21 as it may move together with the support plate 22 when the support plate 22 is tilting.

Figure 5:
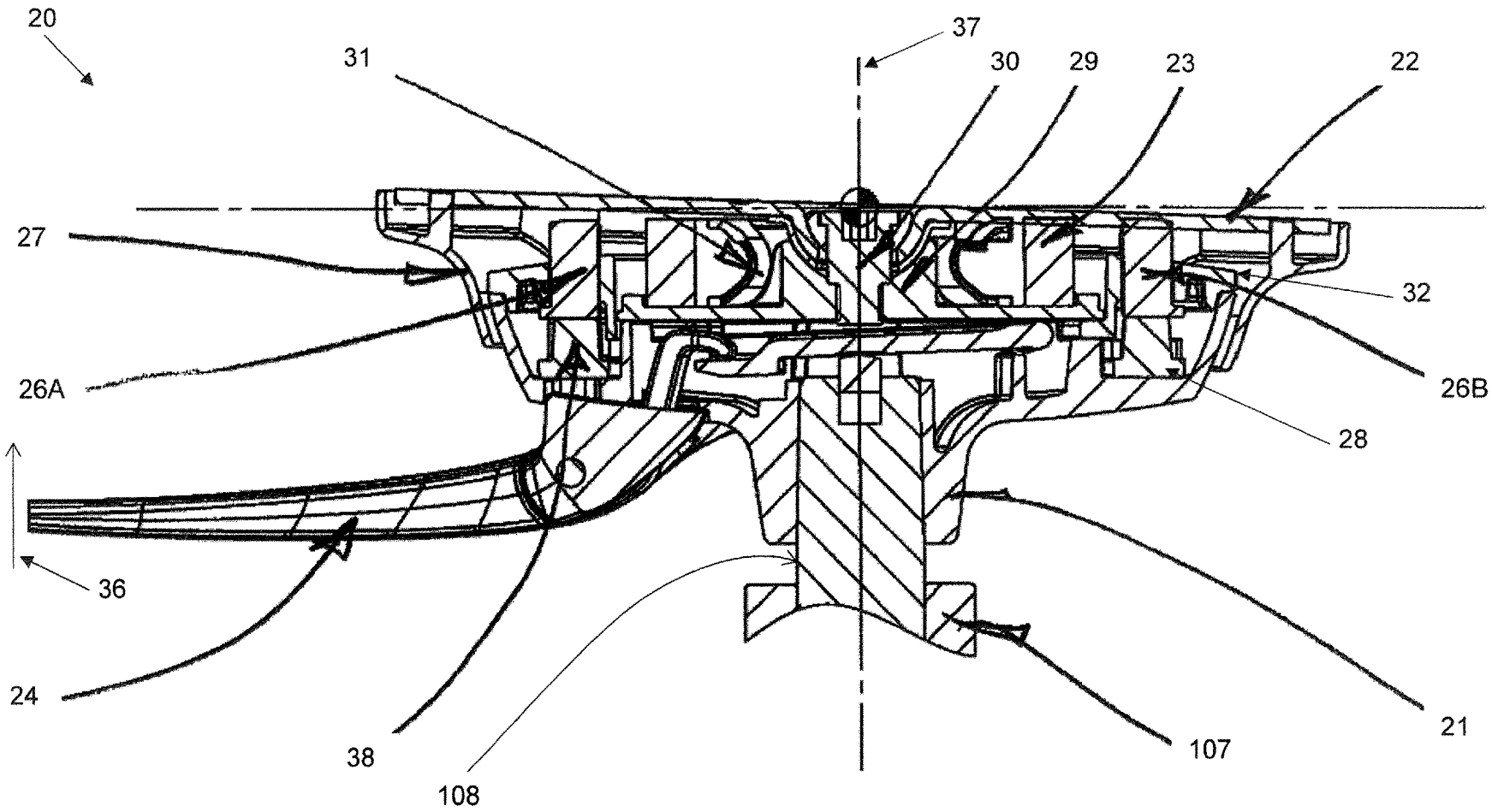
FIG. 5 is a schematic cross-sectional side view of the control mechanism of FIG. 2.

FIG. 5 shows a sectional view of the control mechanism 20 along a vertical lateral sectional plane. In the state of the control mechanism 20 shown in FIG. 5, the stop element adjust mechanism 28 is in a position, in which at least two stop elements, for example the third stop element 26B at the right side of the chair seat 103 and the fourth stop element 26A at the left side of the chair seat 103, are in their extended positions such that upper ends of the stop elements 26A, 26B abut against the lower surface of the support plate 22, thus inhibiting a tilting of the support plate 22 in the left/right direction.

Furthermore, as can be seen in FIG. 5, the control handle 24 is coupled to the gas cylinder 108 such that the gas cylinder 108 may be actuated upon moving the control handle 24 in an upward vertical direction as indicated by arrow 36.

The elastic element 23 may be made of rubber material or injected thermoplastic. The elastic element 23 may have a shape of a ring. A lower surface of the elastic ring may be glued or molded to the base plate 21 and an upper surface of the elastic ring may be glued or molded to the support plate 22. Thus, the support plate 22 cannot rotated with respect to the base plate 21 and cannot be removed from the base plate 21.

Additionally or as an alternative, a pivot element 29 may be provided at the base plate 21 and a bolt 30 may extend through the support plate 22 into the pivot element 29 such that the support plate 22 is tiltable mounted to the base plate 21. Furthermore, an anti-rotating element 31 may be provided between the base plate 21 and the support plate 22 such that the rotation of the support plate 22 around the central axis 37 with respect to the support plate 21 is inhibited. When providing the pivot element 29, the bolt 30 and the anti-rotation element 31, the gluing or molding of the elastic ring to the base plate 21 and the support plate 22 may be omitted.

Figure 6:
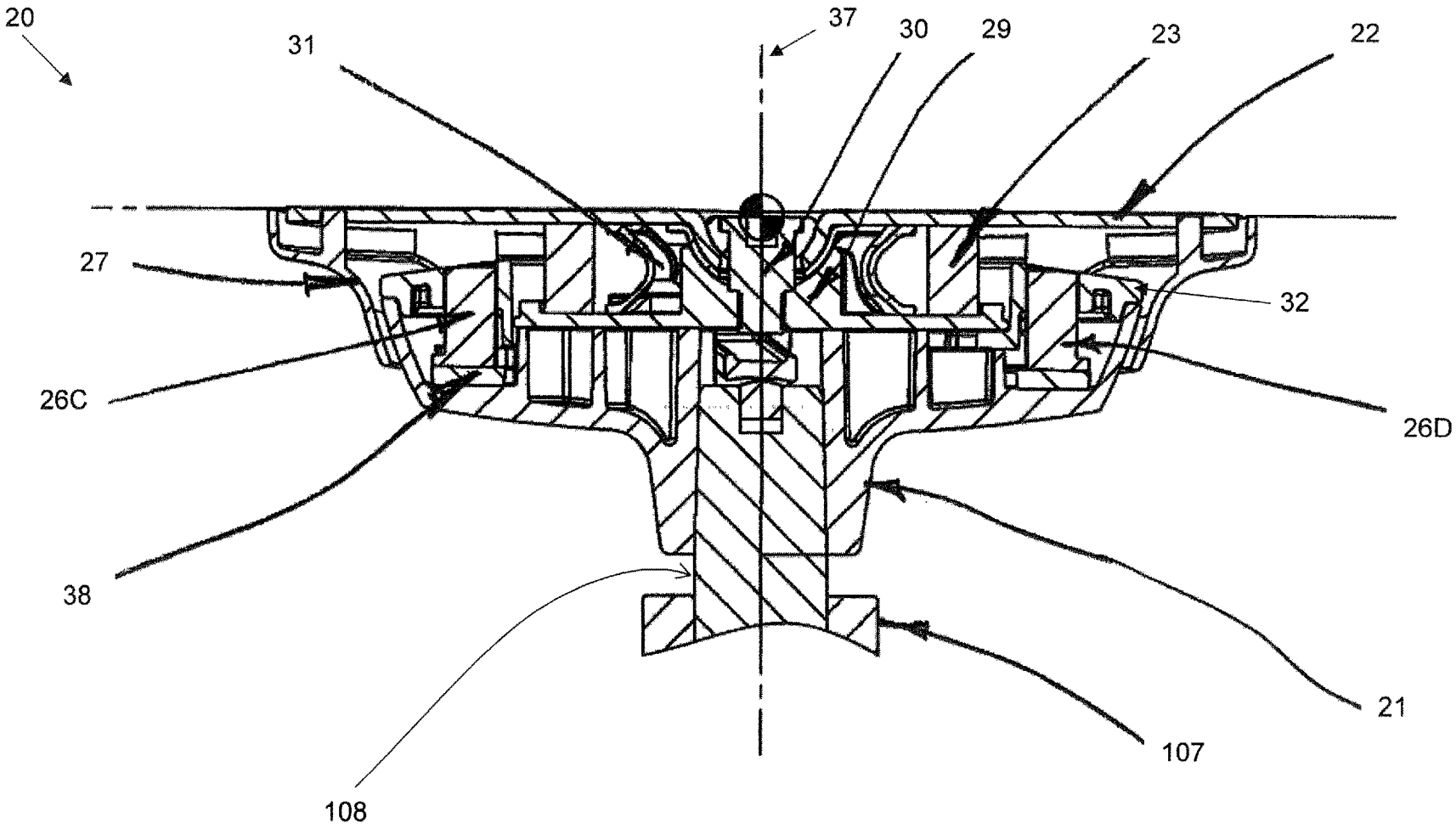
FIG. 6 is another schematic cross-sectional side view of the control mechanism of FIG. 2.

FIG. 6 shows a sectional view of the control mechanism 20 along a vertical forward/rearward sectional plane. In this view, the other two stop elements, i.e. for example the first stop element 26C and second stop element 26D, are visible. In the state shown in FIG. 6, the stop elements 26C, 26D are not in the ramped up extended position and do therefore not protrude from the conical limiter element 32. Thus there is a large distance between an upper surface of the stop elements 26C, 26D and a lower surface of the support plate 22 which enables the support plate 22 to be tilted in the forward and rearward direction.

Controlling the stop elements 26A-26D and thus the tilting of the support plate 22 will be described in more detail in the following in connection with FIGS. 7 to 9. In each of these FIGS. 7 to 9, the control mechanism 20 is shown in a top view and a side view. The top view shows the control mechanism 20 as seen in a vertical top-down direction such that the support plate 22 is visible. In the schematic top view, the support plate 22 is partially transparent such that components below the support plate 22 are visible, in particular the stop elements 26A-26D. The side view shows the control mechanism 20 as seen from for example the right side as defined above. The cover 27 and the base plate 21 are omitted in the side view such that internal details of the control mechanism 20 are more clearly visible, in particular the stop elements 26A-26D, the wedge elements 38, the conical limiter element 32, the stop element adjust mechanism 28, and the elastic element 23.

Figure 7:
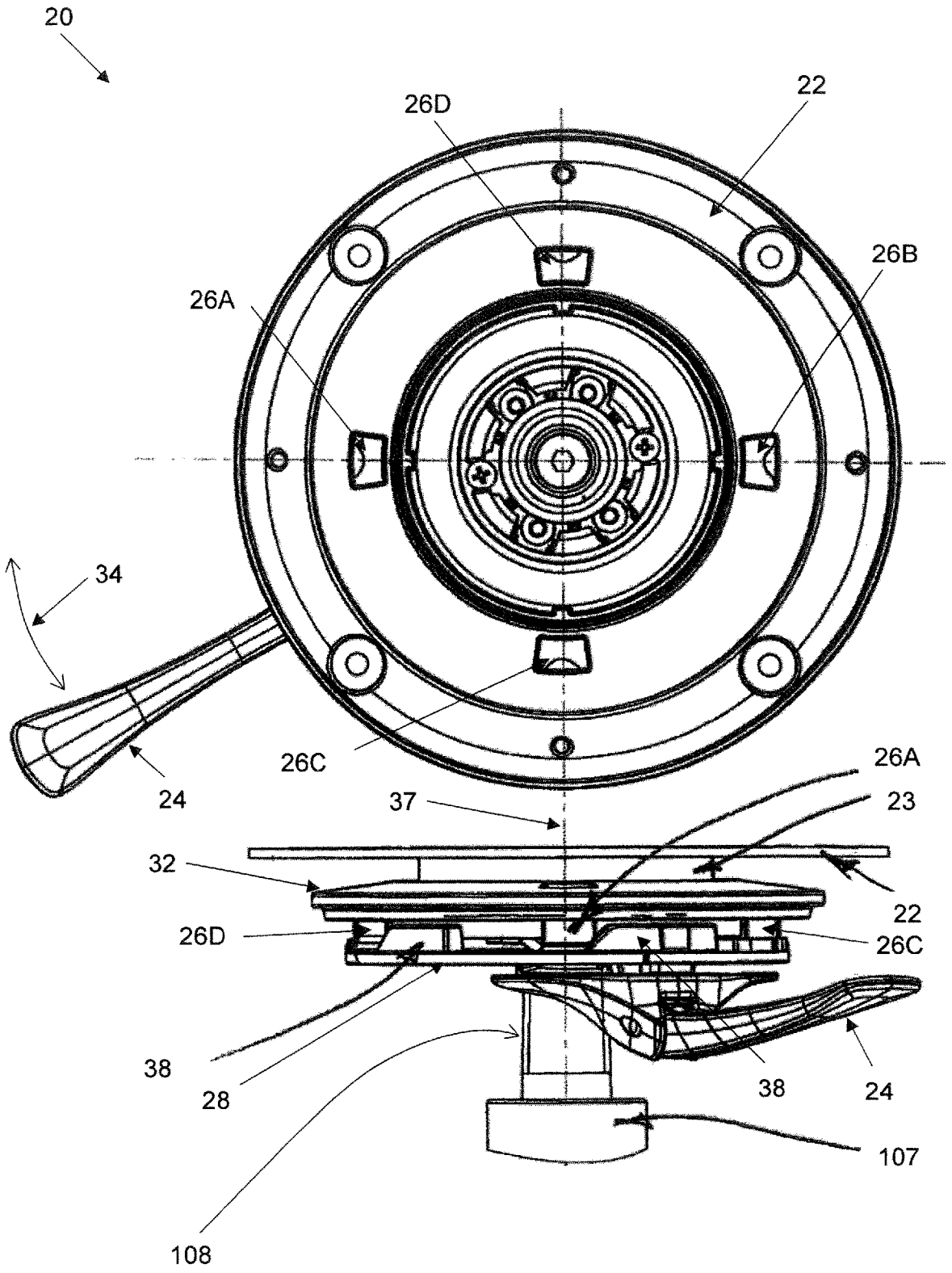
FIG. 7 illustrates a schematic top view and a schematic side view of the control mechanism of FIG. 2 in a first handle position.

FIG. 7 shows the control mechanism 20 in a first handle position of the control handle 24. As explained above, the control handle 24 is coupled to the stop element adjust mechanism 28 such that upon moving the control handle 24 in the direction of arrow 34 the stop element adjust mechanism 28 is also rotated around the central axis 37. In the first handle position, the stop element adjust mechanism 28 is arranged with respect to the stop elements 26A-26D such that none of the stop elements 26A-26D is ramped up by the wedge elements 38. Therefore, all stop elements 26A-26D are in the retracted position and do not protrude from the conical limiter element 32. This enables the support plate 22 to be elastically tilted in any direction by compressing the elastic element 23.

Figure 8:
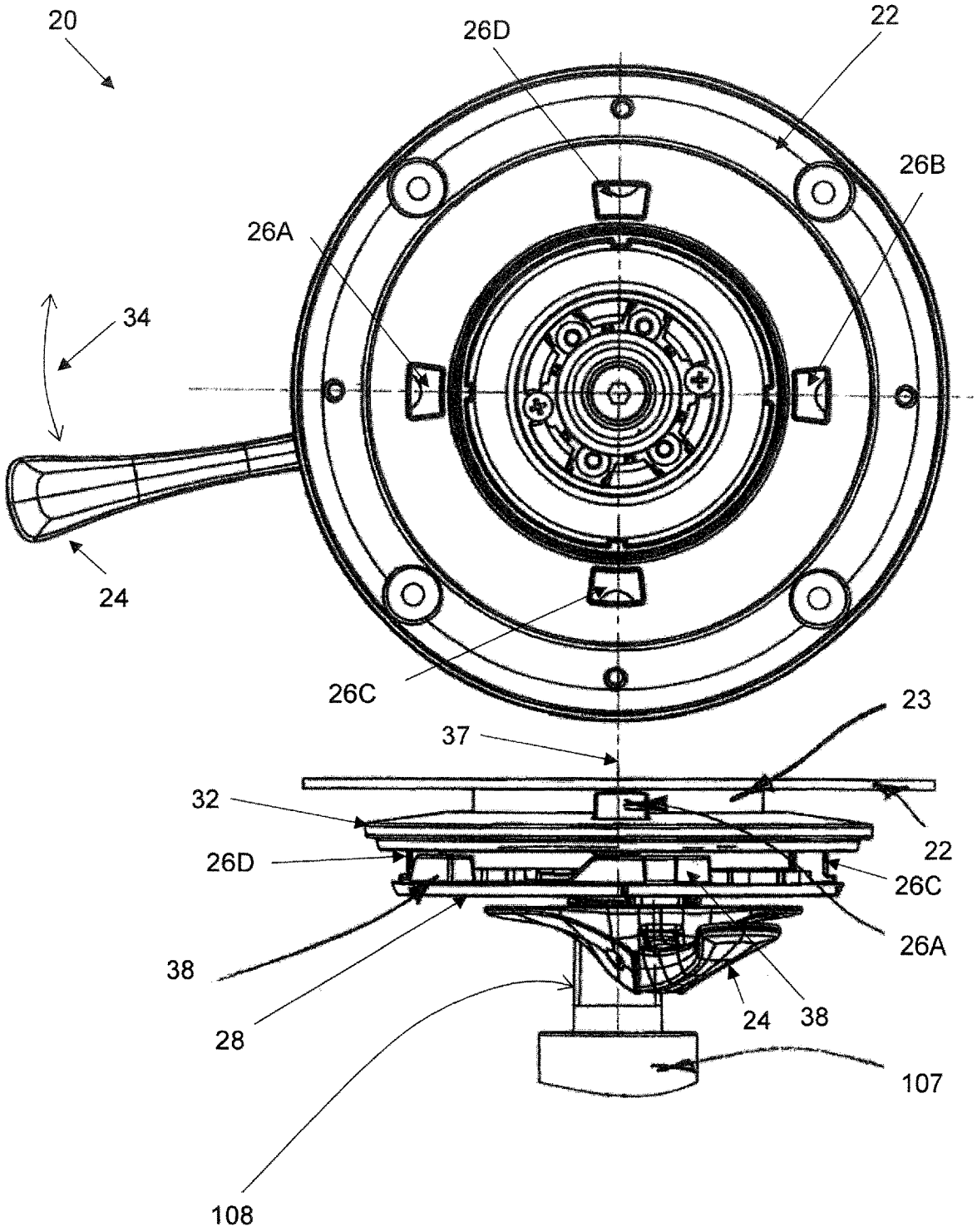
FIG. 8 illustrates a schematic top view and a schematic side view of the control mechanism of FIG. 2 in a second handle position.

FIG. 8 shows the control mechanism 20 in a second handle position of the control handle 24. For gaining the second handle position, the control handle 24 is moved in a clockwise direction from the first handle position. Due to the arrangement of the wedge elements 38 at the stop element adjust mechanism 28, in this second handle position two stop elements 26A and 26B are in their extended ramped up position, whereas the other two stop elements 26C and 26D are still in their retracted position. In FIG. 8 the left stop element 26B and the right stop element 26A are in the extended position and the stop elements 26C and 26D in the forward and backward direction are still in their retracted positions. The left and right stop elements 26A, 26B may be ramped up such that the distance between the upper surface of these stop elements 26A, 26B and a lower surface of the support plate 22 is reduced, preferably such that the upper surfaces of these stop elements 26A, 26B abut against the lower surface of the support plate 22. Thus, the support plate 22 and the chair seat 103 can be tilted in the forward and backward direction only in this second handle position.

Figure 9:
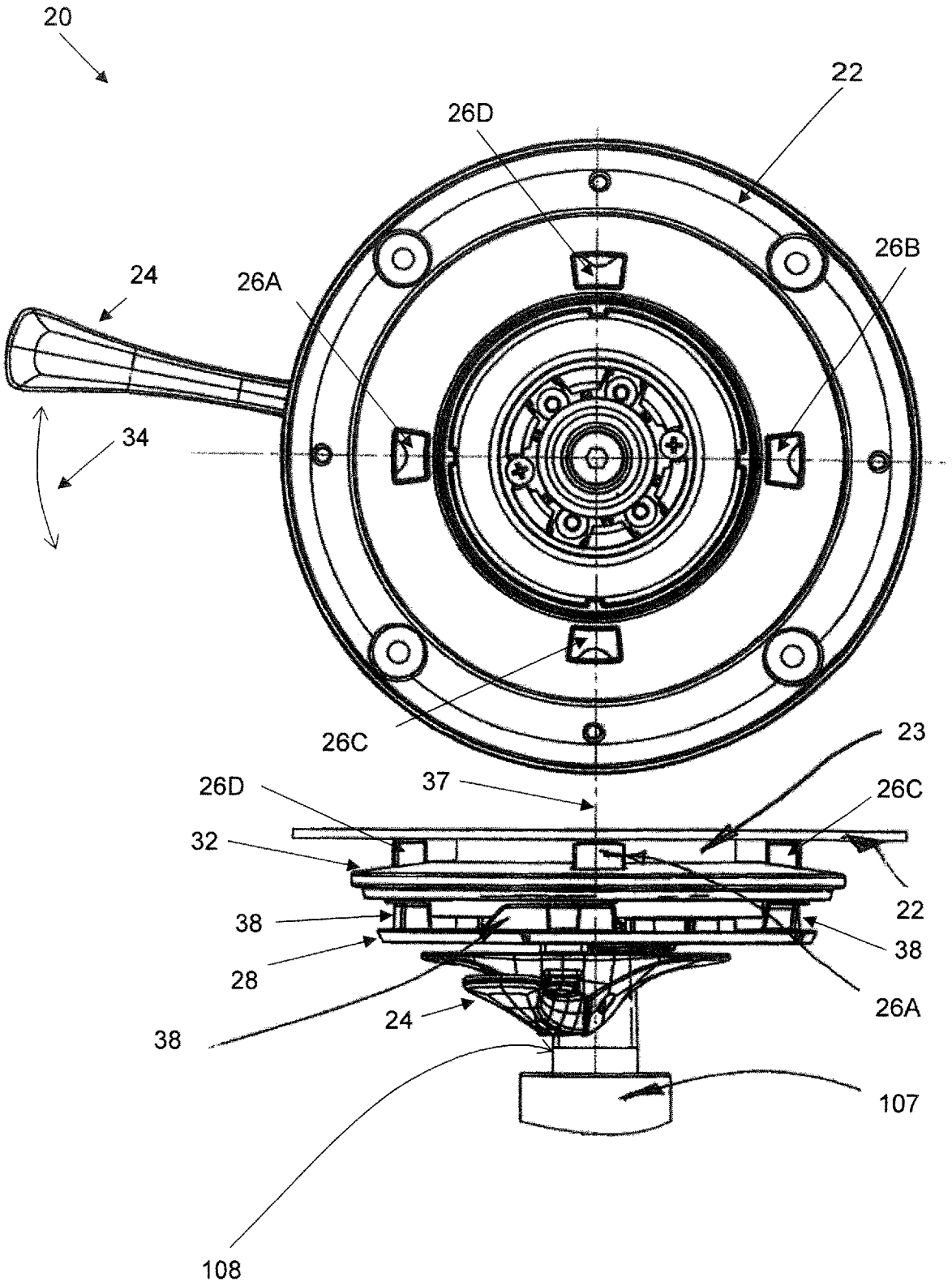
FIG. 9 illustrates a schematic top view and a schematic side view of the control mechanism of FIG. 2 in a third handle position.

FIG. 9 shows the control mechanism 20 in the third handle position of the control handle 24. For gaining the third handle position, the control handle 24 is moved in a clockwise direction from the second handle position. Due to the arrangement of the wedge elements 38 at the stop element adjust mechanism 28, in this third handle position, all four stop elements 26A-26D are in their extended ramped up position. The stop elements 26A-26D may be ramped up such that the distance between the upper surfaces of the stop elements 26A-26D and a lower surface of the support plate 22 is reduced, preferably such that the upper surfaces of the stop elements 26A-26D abut against the lower surface of the support plate 22. Thus, the support plate and the chair seat arranged thereon cannot be tilted anymore in any direction.

It is to be noticed that, for accomplishing the above described tilt restrictions of the support plate 22, the wedge elements 38 may not be arranged equidistant along the stop element adjust mechanism 28, but such that a first pair of wedge elements 38 is arranged diametrical at the stop element adjustment mechanism 28, and a second pair of wedge elements 38 is arranged diametrical in a turning angle other than 90° with respect to the first pair of wedge elements 38, for example in a turning angle of 60° to 80°, in particular 70°.

Furthermore, it is to be noticed that in every handle position, the control handle 24 may be actuated in the vertical direction (see arrow 36 in FIG. 5) to adjust the height of the chair seat 103. Therefore, only one control handle 24 is required for performing two different adjustments.

Further, the chair back 104 may be coupled to the chair seat 103 such that the chair back 104 is tilted together with the chair seat 103. As an alternative, the chair back 104 may be coupled to the base plate 21 such that the chair back 104 remains in its position while the chair seat 103 is tilted.

While the control mechanism 20 described above comprises an elastic ring as the elastic element 23, the elastic element 23 may comprise other materials, for example one or more spring elements, for example steel springs.

While exemplary embodiments have been described in the context of office-type chairs, the control mechanism 20 and the chair 100 according to embodiments of the invention are not limited to this particular application. Rather, embodiments of the invention may be employed to effect a three-dimensional tilting or wobbling of a chair seat in a wide variety of chairs.

The invention claimed is:

1. A control mechanism for a chair, the control mechanism comprising:

a base plate configured to be coupled to a chair base assembly, a support plate configured to be coupled to a chair seat, an elastic element arranged between the base plate and the support plate, the elastic element enabling the support plate to be tilted with respect to the base plate around a first tilt axis and a second tilt axis different from the first tilt axis, a control handle configured to be actuated in an actuating direction in a first handle position, a second handle position and a third handle position, at least four stop elements, each stop element being arranged between the base plate and the support plate and configured to limit a minimum distance between the base plate and the support plate at the position of the corresponding stop element, and a stop element adjust mechanism coupled to the control handle and configured to adjust the minimum distance of each stop element in response to actuating the control handle in the actuating direction, wherein in the first handle position all stop elements of the four stop elements are in the retracted position, in the second handle position two stop elements of the four stop elements are in the retracted position and the other two stop elements of the four stop elements are in the extended position, and in the third handle position all stop elements of the four stop elements are in the extended position.

2. The control mechanism of claim 1, wherein each stop element extends from the base plate towards the support plate and is configured to be separately displaceable between a retracted position and an extended position, wherein, in the extended position, each stop element is further extended towards the support plate than in the retracted position.

3. The control mechanism of claim 2, wherein a number of stop elements in the extended position depends on an extent the control handle is actuated in the actuating direction.

4. The control mechanism of claim 1, wherein the stop element adjust mechanism comprises a rotatable annular plate, wherein at least one wedge element extends from the annular plate, wherein each wedge element of the at least one wedge element is assigned to a corresponding stop element, wherein the minimum distance limited by each stop element is adjusted by the assigned wedge element upon rotating the annular plate.

5. The control mechanism of claim 4, wherein the stop elements of the plurality of stop elements are arranged equidistant along the annular plate.

6. The control mechanism of claim 1, wherein the elastic element comprises an elastic ring.

7. The control mechanism of claim 6, wherein a first face of the elastic ring is molded to the base plate and a second face of the elastic ring opposing the first face is molded to the support plate.

8. The control mechanism of claim 6, further comprising a coupling element providing a pivotable coupling of the base plate and the support plate, wherein the coupling element is arranged in a central position of the elastic ring.

9. The control mechanism of claim 1, wherein the first tilt axis extends essentially perpendicular to a vertical direction, and the second tilt axis extends essentially perpendicular to the vertical direction and the first tilt direction, wherein the vertical direction is defined by a direction in which the chair base assembly, the base plate, the support plate and the chair seat are subsequently arranged.

10. The control mechanism of claim 9, further comprising an anti-rotation element arranged between the base plate and the support plate and configured to prohibit a rotation of the support plate with respect the base plate around the vertical direction.

11. The control mechanism of claim 9, wherein the control handle has a longitudinal shape, wherein a proximal end of the control handle is coupled to the base plate and the control handle extends from the base plate, wherein the control mechanism is configured such that actuating the control handle in the actuating direction comprises moving a distal end of the control handle in a circumferential direction around the vertical direction.

12. The control mechanism of claim 11, wherein the chair base assembly comprises a height control mechanism configured to enable the chair seat of the chair to be displaced in the vertical direction, wherein the control handle is configured to be actuated in a further actuating direction, wherein actuating the control handle in the further actuating direction effects actuation of the height control mechanism, wherein actuating the control handle in the further actuating direction comprises moving the distal end of the control handle in the vertical direction.

13. The control mechanism of claim 1, further comprising an annular cover element attached to a circumferential edge of the support plate and extending to a circumferential edge of the base plate.

14. A chair, comprising a chair base assembly;

a chair seat; and a control mechanism, the control mechanism comprising:

a base plate coupled to the chair base assembly, a support plate coupled to the chair seat, an elastic element arranged between the base plate and the support plate, the elastic element enabling the support plate to be tilted with respect to the base plate around a first tilt axis and a second tilt axis different from the first tilt axis, a control handle configured to be actuated in an actuating direction in a first handle position, a second handle position and a third handle position, at least four stop elements, each stop element being arranged between the base plate and the support plate and configured to limit a minimum distance between the base plate and the support plate at the position of the corresponding stop element, and a stop element adjust mechanism coupled to the control handle and configured to adjust the minimum distance of each stop element in response to actuating the control handle in the actuating direction;

wherein in the first handle position all stop elements of the four stop elements are in the retracted position, in the second handle position two stop elements of the four stop elements are in the retracted position and the other two stop elements of the four stop elements are in the extended position, and in the third handle position all stop elements of the four stop elements are in the extended position.

* * * * *